United States Patent [19]

Barnes

[11] 4,093,128

[45] June 6, 1978

[54] MEAT EXTRUDER HAVING DOUBLE BLADE CUTTER BAR

[75] Inventor: J. Haywood Barnes, Wadsworth, Ohio

[73] Assignees: Edwin W. Oldham; Vern L. Oldham, both of Akron, Ohio ; a part interest to each

[21] Appl. No.: 765,920

[22] Filed: Feb. 7, 1977

Related U.S. Application Data

[63] Continuation-in-part of Ser. No. 635,403, Nov. 26, 1975, Pat. No. 4,036,442.

[51] Int. Cl.[2] ..... B02C 18/36

[52] U.S. Cl. ..... 241/82.5

[58] Field of Search ..... 241/82.1, 82.4, 82.5, 241/82.6, 82.7, 246, 247

[56] References Cited

U.S. PATENT DOCUMENTS

| | | | |
|---|---|---|---|
| 431,230 | 7/1890 | Leopold | 241/82.5 |
| 756,713 | 4/1904 | Sander | 241/82.4 |
| 1,080,875 | 12/1913 | Mayfield et al. | 241/82.5 |
| 2,914,103 | 11/1959 | Ferris | 241/82.5 |
| 3,286,551 | 11/1966 | Tipton | 241/82.5 |
| 3,847,360 | 11/1974 | Seydelmann | 241/82.4 |

*Primary Examiner*—Granville Y. Custer, Jr.

*Attorney, Agent, or Firm*—Oldham, Oldham, Hudak & Weber

[57] ABSTRACT

A rotary cutter means for use with meat cutting or extruding devices including an apertured flat faced discharge means and with the rotary cutter means comprising a planar cutter knife having a plurality of cutter blades extending substantially radially from a support hub. These blades each have an overhanging leading edge axially spaced from the flat face of the discharge means and the blades each have a flat bearing surface thereon positioned adjacent the flat face of the discharge means, the cutting edge being at the leading edge of this flat bearing surface. The device also includes radially extending slots in each of the flat bearing surfaces of the cutter blades and extending the length thereof to form a pair of parallel cutting edges thereon positioned in spaced circumferential relation in the cutter knife.

13 Claims, 7 Drawing Figures

MEAT EXTRUDER HAVING DOUBLE BLADE CUTTER BAR

BACKGROUND OF INVENTION

Reference is made to U.S. Pat. No. 4,036,442, issued July 19, 1977 of which the present application is a continuation-in-part.

In the meat cutting and/or extruding fields, it is believed that the commercial practices therein have remained relatively static for a number of years. That is, apertured flat metal discharge or cutter disc plates are provided in extrusion apparatus having a driven rotary screw therein and with this screw carrying a cutter knife at the end thereof positioned at the flat metal extrusion disc. The knives as used presently have in general comprised some type of a cast structure having, for example, four substantially radially extending fingers thereon and with a hardened cutter insert being provided at a leading edge of each of the cutter blades and forming a very localized or knife edge contact only for engaging the discharge or extrusion disc for presumably cutting meat as forced into the apertures in the extrusion disc. The blades frequently have torn the meat apart rather than cutting the meat.

These cutter blades and extrusion discs as used commercially today have required relatively frequent maintenance, repair or inspection services since the cutter blade tends to become dull relatively rapidly in use and the cutter discs themselves may become gouged or roughened.

The meat extrusion process is used primarily for forming hamburger meat and the like. Naturally, it is desirable to provide this meat in a salable or as useful a condition as possible and it is desired that this extruded meat will have a good shelf life when ground and placed in cold storage until sold. Obviously, it is quite desirable to extrude or form the hamburger or cut meat particles as rapidly as possible and to maintain maximum efficiency from the extrusion equipment.

The general object of the present invention is to provide a novel and improved rotary cutter means or cutter knife for use in meat cutting and extruding devices and wherein the cutter knife has a plurality of cutter blades that have overhanging leading edge surfaces thereon smoothly connected to a leading cutting edge on each blade, which cutting edge is at the circumferentially forward margin of a flat bearing surface provided on each of the cutter blades and postioned adjacent a flat face of an apertured discharge means with which the cutter knife is used.

Another object of the invention is to provide an improved rotary cutter means adapted to extrude or force meat and similar products through an associated discharge means rapidly and at low temperatures to obtain a desirable product having improved or desirable length shelf time.

Another object of the invention is to provide a rotary cutter knife having improved properties both in the amount of meat that can be processed in a cutter means assembly with minimum or no maintenance thereon and where an improved type of a bearing action is provided between the cutter blades and an associated flat surfaced apertured extrusion disc; and to use a one piece metal casting as a cutter knife.

Yet another object of the invention is to provide a rotary cutter means for use in meat extruding devices wherein a plurality of cutter blades are provided that have overhanging leading edges with inclined faces thereon extending axially rearwardly of the cutter blade to a cutting edge at the leading edge of the flat bearing surface provided on each cutter blade adjacent the extrusion disc; to provide a radially extending slot extending the operative length of each cutter blade and the flat surface thereof to provide two circumferentially spaced radially extending cutter edges on each cutter blade; to provide a cutter device which has a self sharpening action on the cutting edges thereof by bearing engagement of one surface forming a portion of the cutting edge against an associated extrusion disc; to provide a cutting edge on a cutting blade of the cutting device of the type described wherein the cutting edge is formed at a substantially 90° angular connection between adjacent surfaces on the cutting blade; to provide substantially circumferentially directed small recesses in radially spaced portions of a cutter blade and extending a short circumferential length thereof to release quantities of meat engaged with the entire leadng edge surface of the cutter blade and nor force or move all of such material contacted toward the associated extrusion disc for extrusion and cutting action; and to control the rate of extrusion and cutting action of the material processed at least partially by the number and size or depth of these bypass recesses formed on the leading edges of the individual cutter blades.

The foregoing and other objects and advantages of the invention will be made more apparent as the specification proceeds.

Reference now is particularly directed to the accompanying drawings, wherein.

When referring to corresponding members shown in the drawings and referred to in the specification, corresponding numerals are used to facilitate comparison therebetween.

SUBJECT MATTER OF INVENTION

Figure 1:
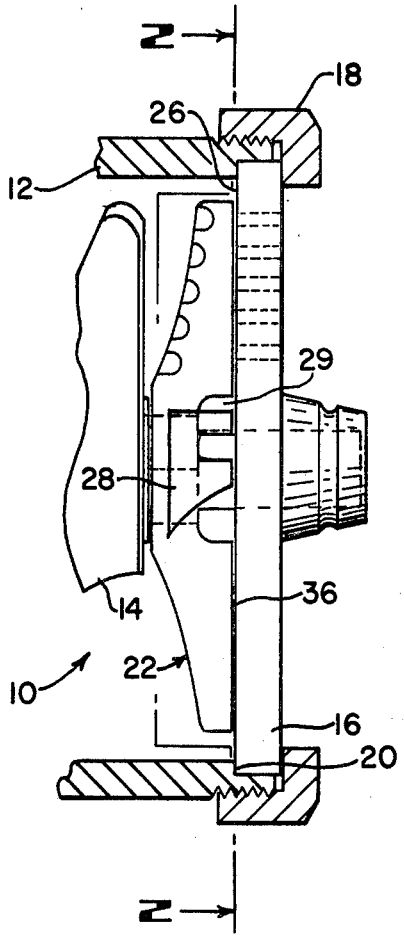
FIG. 1 is a side elevation, partially broken away and shown in vertical section, of a meat cutting or extruding device embodying the principles of the invention and having a novel cutter means of the invention associated therewith.
Figure 2:
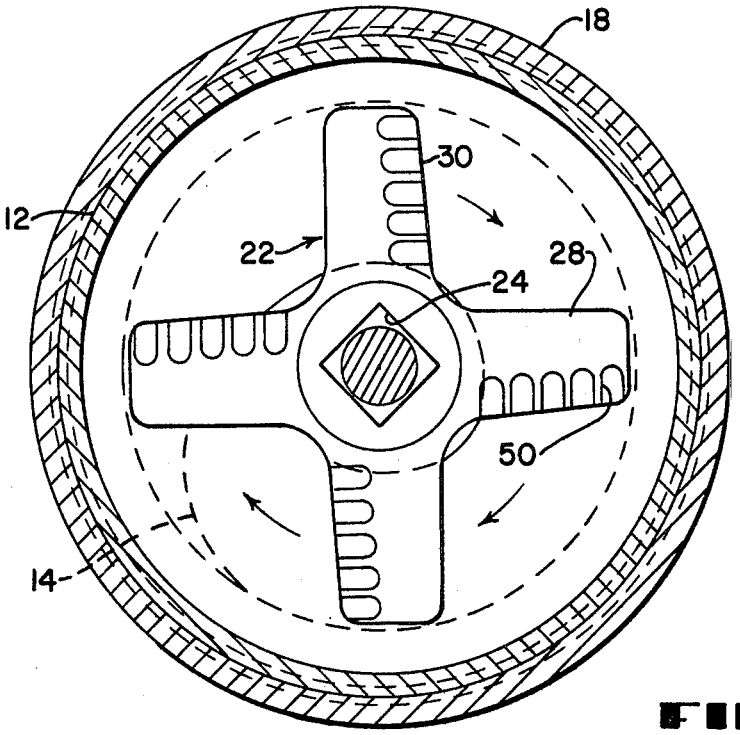
FIG. 2 is a section on line II-II of FIG. 1 to show the novel cutter blade of the invention.

The meat cutting or extruding device of the invention includes and relates to an apertured flat faced discharge means or extrusion disc and to a rotary cutter means, the device or apparatus being characterized by the cutter means including a one piece metal cutter knife having a plurality of cutter blades extending substantially radially thereof with each blade having an overhanging leading edge that is axially spaced from said flat face of said extrusion disc, a cutting edge on each cutter blade adjacent the discharge means, and a substantially flat surface being formed on each cutter blade and extending from said leading edge to the cutting edge, each cutter blade having a flat bearing surface thereon normally bearing on the flat face of said extrusion disc, and with said cutting edge being at the leading edge of the flat bearing surface. The cutter blades also have radially extending slots in each of the flat bearing surfaces and extending the length thereof to provide or form a pair of parallel cutting edges on each cutter blade and positioned in spaced circumferential relation. The cutter blades of the invention are relatively massive in cross section and normally are of greater circumferential length than axial depth, the flat bearing surfaces distributing any axially directed assembly pressures over these flat bearing surfaces, and with the cutting edges of the cutter blades being formed by surfaces intersecting at angles of substantially 90°.

With reference to the details of the construction shown in the drawings, a meat cutting and/or extruding device is indicated as a whole by the numeral 10. This device includes a tubular housing 12 that has a driven extrusion screw 14 positioned therein. This screw 14 and housing 10 are of conventional construction and meat or other material to be extruded is suitably fed to a lefthand input portion (not shown) of the extrusion device. The screw can be manually or power driven, as desired, to force the meat from the device in processed form.

At the extrusion or discharge end of the device 10, an apertured flat faced discharge means or extrusion disc 16 is provided and it is secured over the open end of the tubular housing 12. Normally the disc is secured in position as by a conventional collar 18 releasably engaging the end of the housing 12 and usually abutting the disc 16 against a shoulder 20 formed on the end of the housing 12. The extrusion screw 14 may have an end that is journalled in or positioned by an aperture in the extrusion disc 16. The portions of the device 10 described hereinabove may be of any known construction.

Any conventional type of an extrusion disc 16 is secured in the apparatus, and a rotary cutter means indicated as a whole by the numeral 22 is operatively carried by the end of this screw 14 for meat cutting and extrusion action. Such cutter means is a one-piece metal casting. This rotary cutter normally has a substantially square aperture 24 formed therein that engages a complementary shaped end portion on the screw, and with an end of the rotary cutter means tightly abutting against an end portion of the screw 4 and having a flat operative face or opposite surface on this cutter means abutted against a flat face 26 of this extrusion disc 16.

This disc-like cutter knife has a plurality of cutter blades 28 extending substantially radially thereof in equally spaced circumferential relation. The blades 28 may be offset slightly from and parallel to a radially extending axis or be centered on such axis, as desired. Each of these cutter blades has an overhanging leading edge 30 formed thereon and this leading edge 30 is spaced axially from the flat face 26 of the extrusion disc 16. Such leading edge is connected to a cutting edge 32 formed on each cutter blade by a substantially flat surface 34. This surface 34 may be of a flatly arcuate shape as shown in FIG. 4 of the drawings, but with such face smoothly extending from the leading edge to the cutting edge and forming an angle of slightly more than 90° between a flat surface 36 on each of the cutter blades and defining a plane with the other flat surfaces on the other cutter blades so that such flat surfaces can be abutted on and bear smoothly against the flat face 26 of the extrusion disc.

As a further novel feature of the present invention, each of the cutter blades 28 has a radially extending slot or recess 40 formed in its flat face 36. This slot extends the operative radial length of the cutter blade and a relatively deep slot is formed so that, when the rotary cutter member is in operation, small quantities of processed material, and usually bone chips, tend to accumulate in this slot 40. By this slot 40, a second cutting edge 42 is formed on each of these cutter blades. Such cutting edge is formed at the 90° angle provided by a portion of the flat face 36 of each of these cutter blades and the substantially radially inwardly extending adjacent flat wall 44 of this slot 40. The cutting edge 42 is parallel to the cutting edge 32 of the same cutter blade but is spaced slightly circumferentially in relation thereto.

Figure 3:
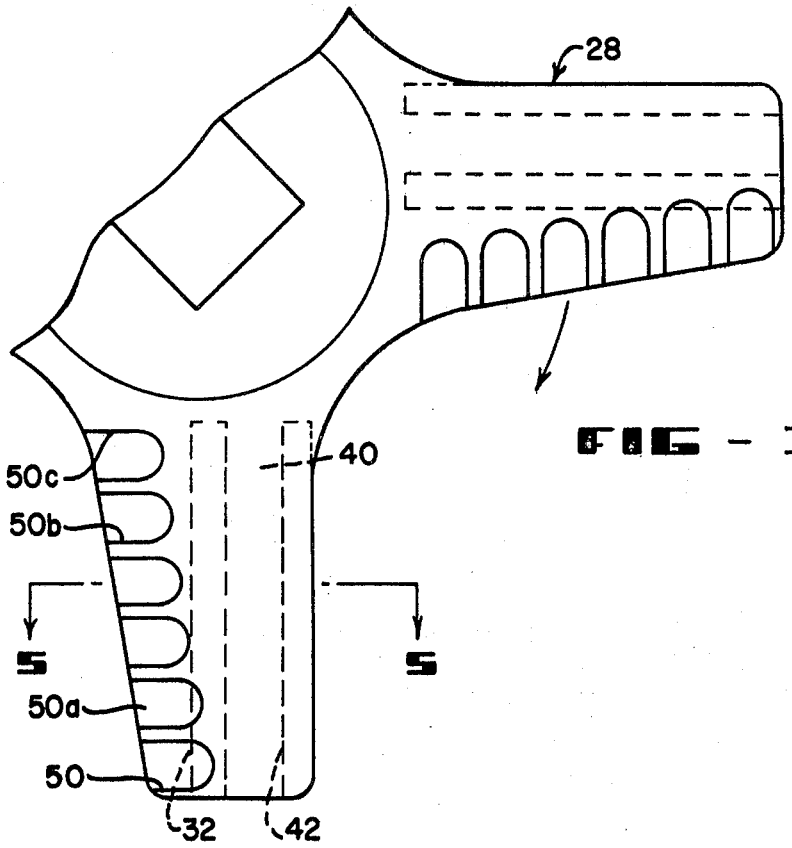
FIG. 3 is a fragmentary plan of an enlarged type of a portion of the cutter means of the invention.
Figure 4:
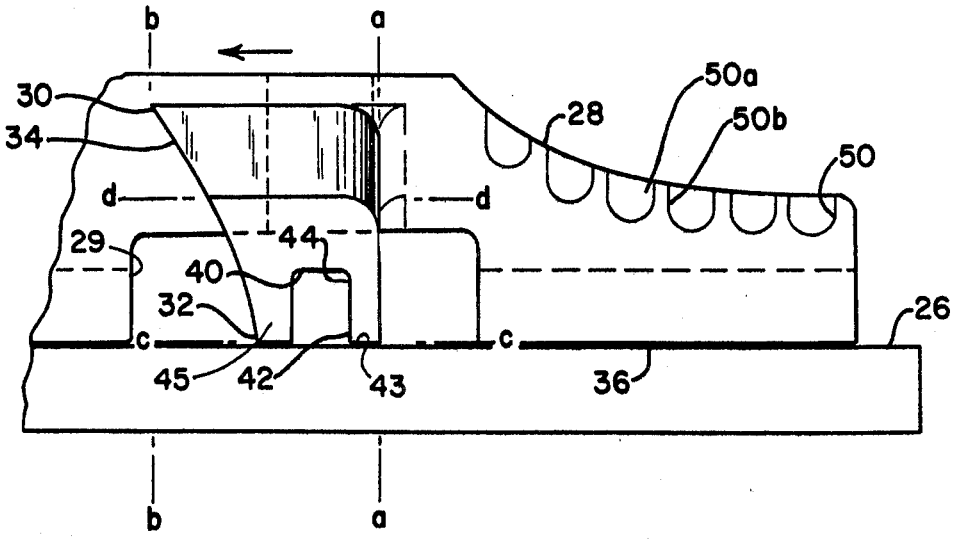
FIG. 4 is a front elevation of the cutter knife of FIG. 3.

The rotary cutter means has a center recess 29 therein on its flat bearing surface formed by the blades 28 terminating short of the center axis of the cutter as best shown in FIGS. 3 and 4. This recess 29 is open between the circumferentially spaced blades 28 and it provides an entrance flow path for bone chips and other matter to move into and collect in the slots 40.

The edge 42 is on the leading edge of a trailing area 43 formed on each cutter blade by the slot 40 which also forms a leading area 45 on each blade flat face 36.

In test use of the extrusion device or cutter means of the invention, it has been found that in some instances, it is desirable to reduce the rate of feed or flow of meat or other processed material through the device of the invention. Hence, it has been found that by the provision of radially spaced, circumferentially short recesses, or grooves 50, **50*a*, 50*b*, 50*c*, etc. in the leading edge 30** and rear surface area of each cutter blade, the rate of flow or movement of meat through the device can be controlled. These grooves permit some of the meat being processed to slide by the rotary cutter means without being forced into and through the extrusion disc on its initial contact with a cutter blade.

It should be noted, as shown in the drawings, that each of these cutter blades is relatively massive as it has an effective circumferential length indicated as between the lines a—a and b—b of FIG. 4, and it has an axial length or thickness at its outermost end indicated by the distance between the line c—c and d—d so that the blade normally is of greater circumferential length than axial depth. Preferably the entire rotary cutter means 22 is formed as a one piece casting from suitable material such as high speed high carbon steel whereby a tough, durable cutting member has been provided and a large quantity of meat can be processed without any resharpening of the blade unit or any other maintenance thereon. In fact, the blade unit has a definite self sharpening action inasmuch as the flat bearing surfaces 36 of each cutter blade are pressed tightly against the adajacent flat surface 26 of the extrusion disc. That is, in the conventional assembly of the apparatus of the invention, pressures are placed on the collar 18 or other member used to hold the assembly together and this forces the cutter disc 16 against the flat surfaces or faces 36 of the cutter blades. By such rather sizable areas on the cutter blades engaging sizable areas on the cutter disc, and with all of such surfaces being flat, seemingly smaller amounts of heat are developed and certainly a better extrusion and cutting action is obtained than if very small edge areas of cutter blades or inserts were in very high pressure contact with the extrusion disc and the flat face thereof.

The apparatus of the invention has been tested and operated very satisfactorily in extruding large quantities and volumes of meat with minimum or no maintainance being required. The cutter blades and apparatus of the invention function to cut meat rather than partially tear or cut meat as occurs in prior known apparatus. Furthermore, the ground meat produced seemingly has no bones therein as any bone particles in the meat being processed tend to be broken way down in size or else to be collected in the slots 40 in the cutter means from which they could be periodically removed. The meat, having been extruded at lower temperatures than normally available in prior conventional apparatus seems to have a better shelf life, such as up to 10% longer shelf life, and the meat is juicier and more desirable.

The individual cutter blades are of greater axial depth adjacent the hub of the cutter means, as seen in FIG. 4, and hence are axially deeper than their circumferential length. But for the greater portion of their lengths, usually the circumferential length normally is the longer dimension.

The rotary cutter means 22 requires no added cutter bars or the like, but does form and maintain in use sharp cutting edges at corners formed by surfaces meeting at substantially 90° angles.

Yet a further action that seems to be obtained by the use of the combined grooves 50 in the cutter blades together with the overhanging leading edges thereof is that a good mixing action is obtained at the front of the cutter blades on the meat being processed. The apparatus achieves a faster production rate than prior devices.

The screw 14 naturally is positioned to abut on means (not shown) whereby it does not move away from the cutter disc 16. The collar 18 is manually tightened to bring the disc 16 up against the cutter blade.

In the apparatus of the invention, it appears that the leading edge 30 functions better in these cutter blades if it is formed to a flatly curved surface as shown in the drawings. However, any inclined surface from an angle of about 88° with the plane defined by the contacting flat surfaces 26 and 36 down to an angle of about 10° would function satisfactorily. However, normally the overhanging leading edge surface would have a lower limit of an angle of from about 30° to 45° with the adjacent flat surface of the cutter disc and usually the angle formed between these two flat or substantially flat surfaces would be in the vicinity of about 75° to 85° but it could even go a little higher. In fact, good cutting and extruding action occurs when the cutter blade is of the shape of the blade **28*b* of FIG. 7. Here, the leading edge 30*a* makes an angle of about 90° with the plane defined by the associated flat face of the cutter disc 16**.

These cutter blades function effectively until the flat surfaces 32 thereof have been worn down to the depth of the slot or groove 40 provided in the cutter blade arm. A very large quantity of meat normally can be processed with no sharpening of the cutter blades being required. The lock ring or collar 18 must be designed so by tightening if after use of the apparatus of the invention, the cutter disc 16 is maintained in pressure engagement with the flat surfaces 36 of the cutter means. Such pressure engagement is maintained in use of the cutter means of the invention. Should the cutting edges 32 and 42 become dull or irregular, grinding off only a few thousandths of an inch from the flat aligned surfaces 32 and 36 sharpens the blades for continued good cutting action.

Figure 5:
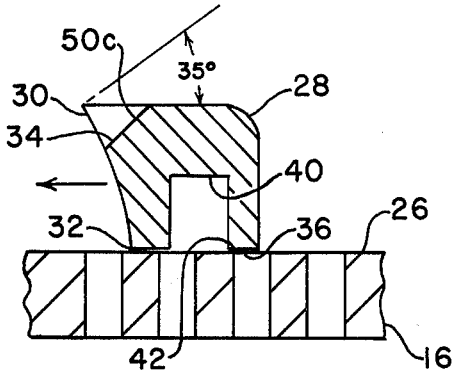
FIG. 5 is a section of a cutter blade taken on line 5—5 of FIG. 3.

FIG. 5 shows that the bottom of the recesses 50 may be inclined at an angle of, for example, about 35° to the cutter disc to facilitate flow of meat past the cutter blade. These recesses can vary appreciably in size and shape to aid in controlling the rate of meat flow through a cutter apparatus of the invention. By inclining the axes of the recesses radially inwardly or outwardly at small acute angles, the mixing action of the meat being processed is improved. The recesses 50 seem to aid in forming a sturdy cutter blade with good properties for meat extrusion and also to aid in contol of the rate of extrusion by variation in the number, shape and size of the recesses. The recesses preferably do not extend circumferentially more than about 25 to 40% of the circumferential width of the blade. The extrusion rate also can be varied by change of the axial depth of the cutter bars.

Figure 6:
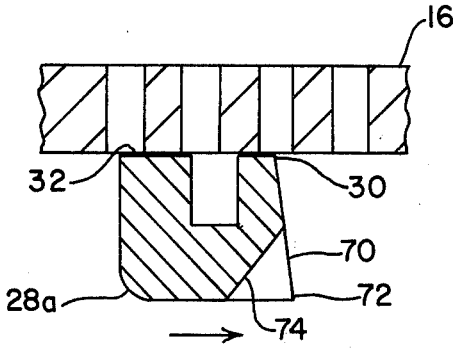
FIGS. 6 and 7 are sections of modifications of the cutter blades of the invention.

FIG. 6 shows a flat, inclined leading surface 70 on a cutter blade **28*a* that connects to a sharp leading edge 72. Recess 74** also is shown.

Figure 7:
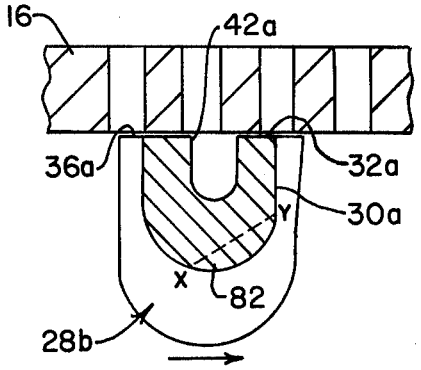

FIG. 7 illustrates a cutter of the invention having a pair of parallel cutting edges **32*a* and 42*a* formed at the corners of the intersections of a flat leading edge surface 30*a* with a flat bearing surface 36*a* and of the trailing wall of the slot 40*a* with the surface 36*a*. The blade 28*b* has a rounded axially outer or rear periphery 82 and the blade gradually reduces in axial thickness towards its radial outer end. The edge surface 30*a* extends at 90° from flat bearing surfaces 36*a* on the cutter blade. The blade 28*b* is shown in section near its radially outer end. Good results have been obtained by this cutter means of FIG. 7 and the two adjacent parallel cutting edges 32*a* and 42*a***.

The slots 40 preferably are centered in the blades and provide the second cutting edge 42 in the blade. Such second cutting blade appears to aid in obtaining good meat extrusion action and it does avoid or reduce the extrusion of any sizable bone chips.

A dotted line x-y indicates the bottom surface of one of a series of radially spaced feed control recesses that may be formed in the blade **28*b* if desired. Such blade has its leading edge 30*a* that connects to the rear surface 82, and a leading edge area is provided by the wall 30*a* and the adjacent part of the curved surface 82**. Any suitable number and size of the recesses may be provided as in the other cutter blades of the invention.

Of course, the slots 40, when formed in one cutter blade arm, usually are formed in all of the arms of a cutter blade.

In view of the foregoing, it is believed that the objects of the invention have been achieved.

While several complete embodiments of the invention have been disclosed herein, it will be appreciated that modification of these particular embodiments of the invention may be resorted to without departing from the scope of the invention.

What is claimed is:

1. In a meat cutting and/or extrusion device including a frame having a tubular portion in which a driven screw extruding means is positioned for forcing meat along the axis of such frame portion, the combination of an apertured discharge means carried by said frame at an end thereof and positioned normal to said axis, a rotatable cutter means secured to said extruding means immediately adjacent said discharge means for cutting the meat into pieces, said discharge means comprising an apertured flat surface disc, said cutter means including a plurality of substantially radially extending cutting blades and a hub portion engaged with an end portion of said screw extruding means, the cutting blades each having an overhanging leading edge connected to a cutting edge of the cutting blades by an inclined surface that aids in moving material being processed towards said discharge means, said cutting blades each having a plurality of radially spaced, substantially circumferentially extending recesses formed in their leading edges.

2. In a meat cutting and/or extruding device as in claim 1, where said cutter blades each have a flat surface thereon bearing on said disc, and a radially extending recess formed in each of said flat surfaces so that a second cutting edge is formed on each of said cutter blades.

3. In a meat cutting and/or extruding device as in claim 1 where said cutter blades each have a flat surface thereon bearing on a surface of said metal disc, and said cutting edge is formed at the corner formed by said cutter blade flat surface and said inclined surface, said inclined surface being relatively flat, such surfaces forming an angle thereby of slightly greater than 90°.

4. In a meat cutting and/or extruding device as in claim 1, where said cutter means is a cutter knife having a plurality of cutter blades of substantially square shape in section and having its overhanging edge protruding forwardly from the remainder of the cutter blade, each said blade having material release recesses formed in their leading edges and adjacent areas of the cutter blades remote from a flat bearing surface on each blade.

5. In a meat cutting and/or extruding device as in claim 1, where said blades each have flat bearing surfaces formed thereon, and each said blade has a plurality of radially spaced material release recesses formed in their leading edges and adjacent areas on back portions of the blades remote from said flat bearing surfaces.

6. In a meat cutting and/or extruding device as in claim 5 where said release recesses have bottom surfaces inclined at an acute angle extending away from said flat bearing surface.

7. A rotary cutter means for a meat cutting and/or extruding device including an apertured flat faced discharge means and where such cutter means is characterized by including a cutter knife having a plurality of cutter blades extending substantially radially thereof, said cutter blades each having a flat bearing surface thereon adapted to be positioned against said flat face of said discharge means, each blade when operatively positioned having a cutting edge at the leading edge of said flat bearing surface, and having a rear surface axially spaced from said flat bearing surface, and a plurality of circumferentially extending recesses in each of said blades in the rear surfaces thereof, which recesses are in the leading edge areas of the blades.

8. In a meat cutting and/or extruding device as in claim 7, where said recesses in each of said blades are radially spaced from each other and have bottom surfaces of maximum depth at the leading edge areas of the blades.

9. In a meat cutting and/or extruding device as in claim 7, the provision of a radially extending slot in each of said cutter blades in the flat bearing surface thereon.

10. A rotary cutter means for a meat cutting and/or extruding device including an apertured flat faced discharge means and where such cutter means is characterized by including a rotary cutter knife having a plurality of cutter blades extending substantially radially thereof, said cutter blades each having a flat bearing surface thereon for cooperating with said flat face of said discharge means, each blade having a cutting edge at the leading edge of said flat bearing surface, and a radially extending slot in said flat bearing surfaces forming a second cutting edge on each of said cutter blades intermediate the leading and trailing edges of said flat bearing surface, said flat bearing surfaces of said cutter blades terminating at radially inner ends thereof short of the center axis of said cutter knife to form a center recess connecting to said flat bearing surfaces at the radially inner ends of said slots to aid in flow of processed material to and from said slots.

11. In a meat cutting and/or extruding device as in claim 10, the provision of said second cutting edge being formed on each said cutting blade by the intersection at a 90° angle of a flat wall of said slot and an edge of said flat bearing surface.

12. In a meat cutting and/or extruding device as in claim 10, where said cutting edges are parallel, said flat bearing surfaces each having two circumferentially spaced, radially extending portions, each portion having a leading cutting edge on corresponding edges of said radially extending portions for concurrent cutting action thereby on rotation of said cutter knife in the direction to make said cutting edges the leading edges of said cutter blades.

13. A rotary cutter means for a meat cutting and/or extruding device including an apertured flat faced discharge means and where such cutter means is characterized by including a rotary cutter knife having a plurality of cutter blades extending substantially radially thereof, said cutter blades each having a flat bearing surface thereon for cooperating with said flat face of said discharge means, each blade having a cutting edge at the leading edge of said flat bearing surface, and a radially extending slot in said flat bearing surfaces forming a second cutting edge on each of said cutter blades intermediate the leading and trailing edges of said flat bearing surfaces; and each of said cutter blades having a leading edge portion thereon axially spaced from its said flat bearing surface but connecting to the flat bearing surface thereon, and a plurality of radially spaced recesses formed in said leading edge portion and adjacent areas of said blades remote from said flat bearing surfaces.

* * * * *